United States Patent [19]

McAllister et al.

[11] 3,991,511

[45] Nov. 16, 1976

[54] GEOMETRIC CONSTRUCTION PIECE

[76] Inventors: Jack G. McAllister, 2701 N. Douglas Drive, Minneapolis, Minn. 55422; Richard O. Bartz, 7017 Mark Terrace Drive, Edina, Minn. 55435

[22] Filed: Feb. 26, 1975

[21] Appl. No.: 553,084

[52] U.S. Cl. ..... 46/25; 46/30

[51] Int. Cl.[2] ..... A63H 33/08

[58] Field of Search ..... 46/23, 25, 30

[56] References Cited

UNITED STATES PATENTS

| | | | |
|---|---|---|---|
| 3,340,781 | 9/1967 | See | 46/25 |
| 3,564,758 | 2/1971 | Willis | 46/25 |
| 3,698,124 | 10/1972 | Reitzel | 46/30 |
| 3,701,214 | 10/1972 | Sakamoto | 46/25 |
| D234,791 | 4/1975 | McAllister et al. | 46/23 |

*Primary Examiner*—Louis G. Mancene
*Assistant Examiner*—Robert F. Cutting
*Attorney, Agent, or Firm*—Burd, Braddock & Bartz

[57] ABSTRACT

A construction member having a ring-shaped body with an outer edge and an inner edge. The outer edge has a plurality of inwardly directed notches and the inner edge has a plurality of outwardly directed notches. The notches accommodate additional construction members so that two or more construction members can be connected together. The construction members can have the shape of a square, triangle, circle or other multisided shapes.

21 Claims, 22 Drawing Figures

GEOMETRIC CONSTRUCTION PIECE

CROSS REFERENCE TO RELATED APPLICATION

This application is related to U.S. applications Ser. Nos. 331,503, filed Feb. 12, 1973, now U.S. Design Pat. No. 236,227; U.S. application Ser. No. 506,587 filed Sept. 16, 1974, now U.S. Design Pat. No. 236,221; U.S. application Ser. No. 506,589 filed Sept. 16, 1974, now U.S. Design Pat. No. 236,222; U.S. application Ser. No. 506,590 filed Sept. 16, 1974, now U.S. Design Pat. No. 236,223; and U.S. application Ser. No. 386,031 filed Aug. 6, 1973, now U.S. Design Pat. No. 234,791.

BACKGROUND OF INVENTION

Objects that can be personally touched and manipulated are used to enrich a person's learning environment. Many objects are designed to stimulate curiosity and creativity and develop personal confidence and enthusiasm. The objects are used as educational items and must be sturdy and durable to provide a permissive atmosphere where a person can exercise his needs for touch and feel, and even throw, pound and torture.

It is known that children need early physical experiences with the shape and weight of objects. These experiences require much handling and doing. The experiences include building a whole out of parts. The child must find the parts and provide a maximum number to build a structure. The construction of a structure to a relatively large size that does not topple is a challenging and rewarding experience. Examples of items used for structural building are snap-together beads, rods and connectors, erection sets, and interlocking logs and bricks.

SUMMARY OF INVENTION

The invention is related to a manually manipulative construction member or construction piece used to form symmetrical and asymmetrical structural designs. The construction piece has a circuitous ring-shaped body having an inner edge and an outer edge. The body has continuous side walls that are interrupted with a plurality of notches. A first set of notches extends inwardly from the outer edge of the body. A second set of notches extends outwardly from the inner edge of the body. The notches are arranged in opposite pairs so as to permit a like construction piece to be interlocked with the first construction piece. The circuitous shape of the body can be circular, hexagonal, square, rectangular, triangular and like annular shapes.

An object of the invention is to provide a geometric construction piece that is safe in use for all ages and has a long life. Another object of the invention is to provide a geometric construction piece that can be interlocked with other geometric construction pieces to form numerous shapes and color arrangements, thereby stimulating creativity and develop hand and eye coordination. A further object of the invention is to provide a construction piece that is made of non-toxic, lightweight and durable material that is low cost and easy to store in a relatively compact place or container. Yet another object of the invention is to provide an interlocking construction piece that can be used to provide experience with space and design and can be easily manipulated with small hands. Other objects are set forth in the following description of the construction pieces.

IN THE DRAWINGS

DESCRIPTION OF PREFERRED EMBODIMENTS

Figure 1:
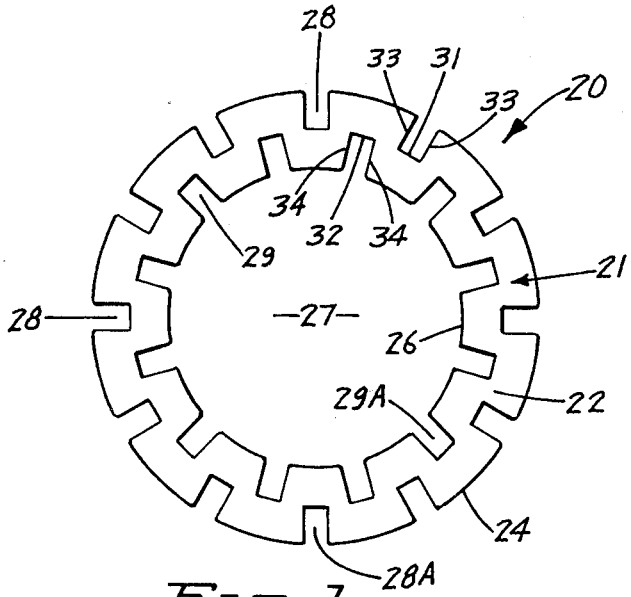
FIG. 1 is a front plan view of a first modification of the construction piece of the invention.
Figure 2:
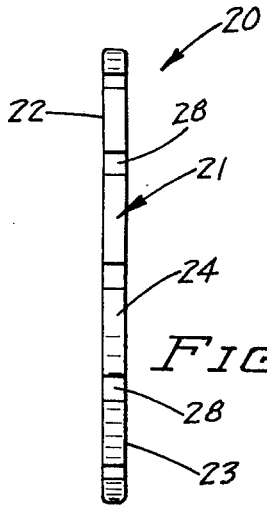
FIG. 2 is an end elevational view of FIG. 1.

Referring to FIGS. 1 and 2, there is shown a first embodiment of the construction piece of the invention indicated generally at 20. Construction piece 20 has a continuous generally flat body 21 with flat sides 22 and 23. Body 21 is made of continuous flexible material, as plastic, paper, rubber or fiber material. For example, the body can be made of a plastic material, as low density polyethylene, foamed polyurethane and like plastics. Other types of materials can be used to make the body. The material should be flexible, have a high tear strength and be non-toxic to the human body.

Body 21 has an outer edge 24 and an inner edge 26 defining the inner and outer dimensions of the circular configuration of the body. The inner edge 26 surrounds an opening 27. The body 21 has a plurality of inwardly directed notches 28 open to the outer edge 24. Notches 24 are circumferentially spaced about the body 21 and are equally spaced from each other. As shown in FIG. 1, body 21 has twelve notches 28. The notches 28 are located in diametric pairs. The top notch 28 is directly opposite bottom notch 28A.

The inner edge 26 is interrupted with a plurality of inwardly directed notches 29. Notches 29 are located in diametrically opposite pairs, as illustrated by notch 29 and notch 29A. Body 21 has twelve inner notches 29 circumferentially spaced about edge 26. Adjacent notches are equally spaced from each other and are located along radial lines extended between adjacent outer notches 28.

Notch 29 has a circumferential bottom 31 in circumferential alignment with bottom 32 of notch 29. The notch 28 has side walls 33. Notch 29 has side walls 34. Side walls 33 and 34 have equal length whereby the bottom or base portions 31 and 32 of the respective notches lie along the same circumferential or circular line.

The circumferential distances between side walls 33 of notches 28 and side walls 34 of notches 29 is equal to the thickness of the body 21. For example, body 21 can be 0.5 cm. in thickness and 1 cm. in width and the notches 28 and 29 can be 0.5 cm. wide and 0.5 cm. long.

This arrangement permits a second piece identical with the piece shown in FIGS. 1 and 2 to be interlocked with the piece 20. The notches of the second piece 28 fit into inner notches 29 and 29A of piece 20 thereby interlocking the pieces. Additional pieces can be added to either the first or second piece to build a desired structure.

Figure 3:
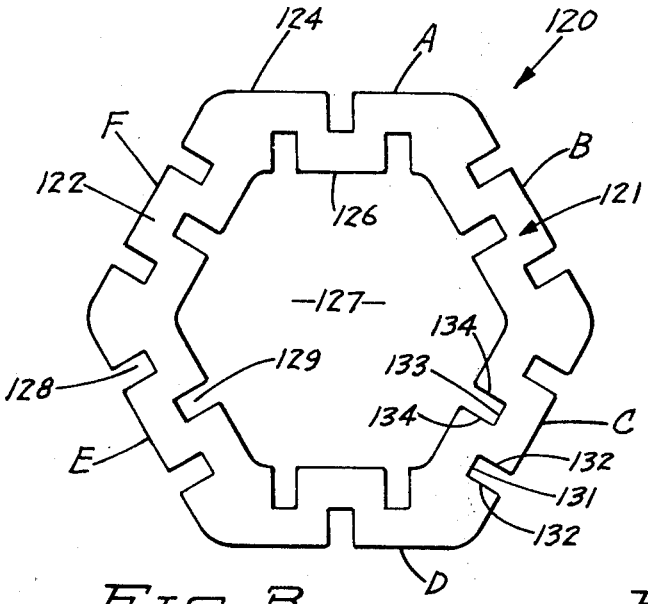
FIG. 3 is a front plan view of a second modification of the construction piece of the invention.
Figure 4:
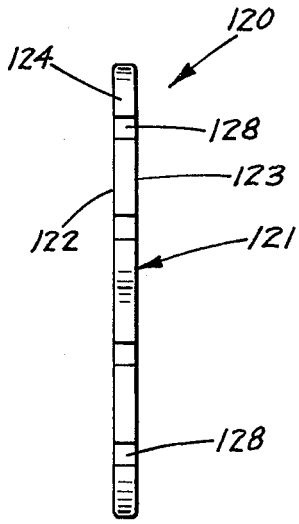
FIG. 4 is an end elevational view of FIG. 2.
Figure 5:
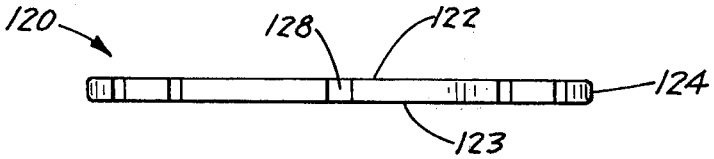
FIG. 5 is a bottom elevational view of FIG. 3.

FIGS. 3, 4 and 5 show a second embodiment of the construction piece of the invention indicated generally at 120. Piece 120 has a continuous circuitous body 121. Body 121 has flat opposite side surfaces 122 and 123. Body 121 has a hexagonal shape with an outer edge 124 and an inner edge 126 and round corners. Inner edge 126 surrounds opening 127. Body 121 has a plurality of outside notches 128 which extend from outer edge 124 into the body and outwardly directed notches 129 extended from inside edge 126. Notches 128 and 129 are circumferentially arranged around the body and are in opposite pairs on opposite portions of the body.

Body has a plurality of segments A–F. Each segment has three notches. Segments A and D have one outside notch and two inside notches. Segments B, C, E and F have two outside notches and one inside notch. The outside notches have a base or bottom portion 131 and side walls 132. The inside notches have a base 188 and side walls 134 to form generally rectangular shaped notches. The bases 131 and 133 are located generally along the same line so that notches 128 and 129 have substantially the same depth. The width of notches 128 and 129 is about the same as the width of body 121. The body 121 can be interlocked with other bodies of the same shape as well as member 20 shown in FIG. 1. The diametric dimension between bases of the inside notches and the bases of the outside notches of bodies 21 and 121 are substantially the same whereby the bodies can interlock to form geometric structures.

Figure 6:
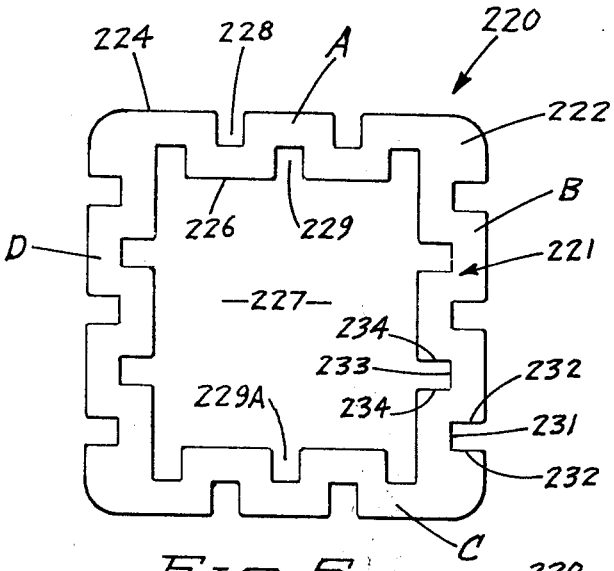
FIG. 6 is a front plan view of a third modification of the construction piece.
Figure 7:
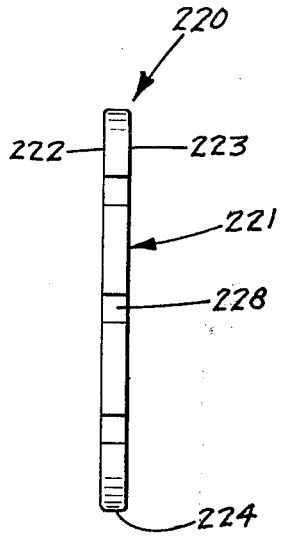
FIG. 7 is an end elevational view of FIG. 6.
Figure 8:
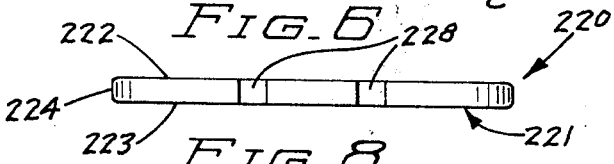
FIG. 8 is a bottom elevational view of FIG. 6.

FIGS. 6–8 show a third modification of the construction piece of the invention indicated generally at 220. Piece 220 has a generally flat body 221 with opposite flat sides 222 and 223. The body 221 has an outer edge 224 and an inner edge 226. The inner edge 226 surrounds opening 227. Body 221 has a generally square shape with side segments A–D of substantially the same length. The outside corners are rounded to eliminate sharp corners. Body 221 has a plurality of inwardly directed notches 228 that open outwardly at the outer edge 224. A plurality of outwardly directed notches open to the inside edge 226. The notches have bottom bases 231 and 232 that lie generally along the same line or plane so that the notches have generally the same depth. The width of the notches is approximately equal to the width of the body. The outer notch 228 has side wall 232 and the inner notch 229 has side walls 234.

Segments A and C have two outer notches and three inner notches. Segments B and D have three outer notches and two inner notches. The notches are arranged in opposite pairs so as to accommodate a second construction piece that is similar in construction to construction piece 220 or construction pieces 20 and 120.

Figure 9:
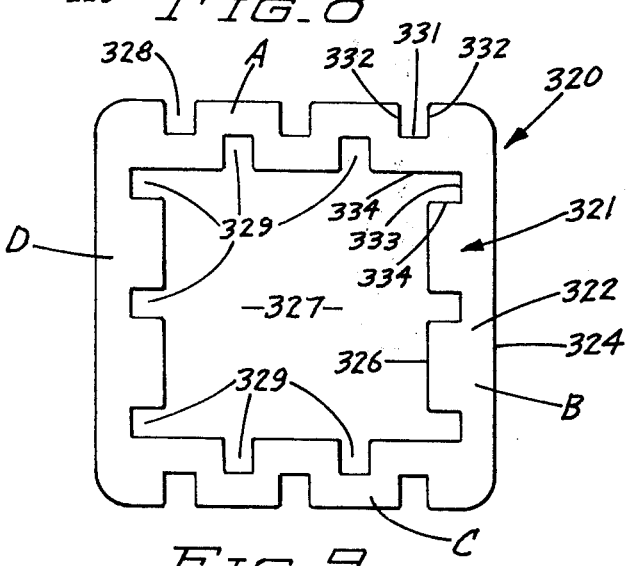
FIG. 9 is a front plan view of a fourth modification of the construction piece.
Figure 10:
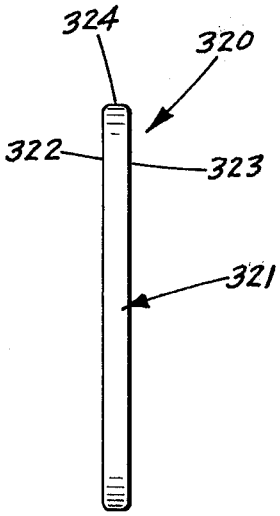
FIG. 10 is an end elevational view of FIG. 9.
Figure 11:
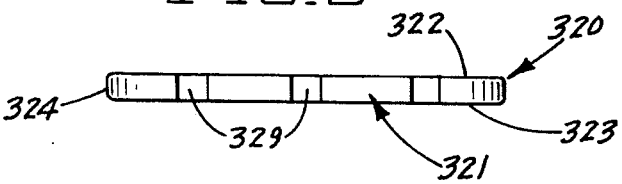
FIG. 11 is a bottom elevational view of FIG. 9.

Referring to FIGS. 9–11, there is shown a fourth modification of the construction piece indicated generally at 320. Piece 320 has a generally flat body 321 with flat continuous side surfaces 322 and 323. Body 321 has a circuitous outer edge 24 and an inner edge 326. The inner edge 326 surrounds a square opening 327. Body 321 is a generally square shape of a size substantially the size of body 221. The outside corners are round. Body 321 has a plurality of notches 328 extended outwardly and open to the outer edge 324 and a plurality of inwardly directed notches 329 open to the inner edge 326. The body has four segments A–D. The outer notches 328 are in segments A and C. The inner segments are in segments A and D.

Notches 328 have bottoms or bases 331 and side walls 322. The inner notches 329 have bases 333 and side walls 334. Bases 331 and 333 are located along the same planes dividing the walls of body 320. The notches 328 and 329 have a width about equal to the width of the body so that a second body can fit into the notches in an interlocking arrangement.

Figure 12:
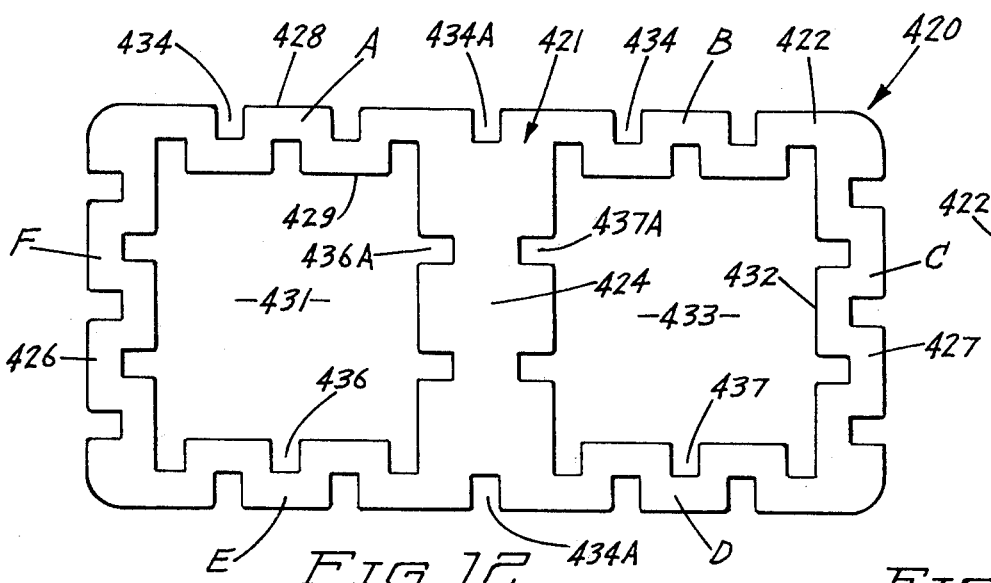
FIG. 12 is a front plan view of a fifth modification of the construction piece.
Figure 13:
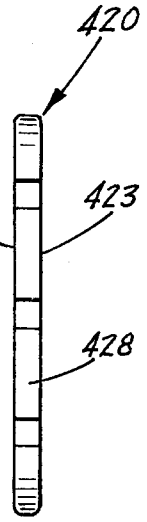
FIG. 13 is an end elevational view of FIG. 12.
Figure 14:
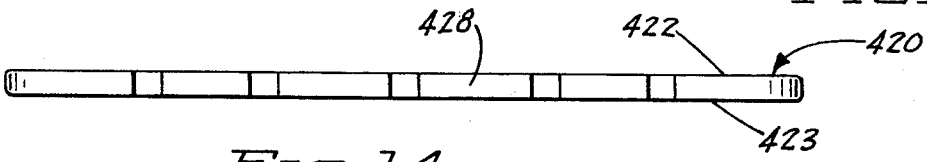
FIG. 14 is a bottom elevational view of FIG. 12.

Referring to FIGS. 12–14, there is shown a fifth modification of the construction piece indicated generally at 420. Piece 420 has a generally flat rectangular body 421 with flat continuous sides 422 and 423. The outside corners of body 421 are round. The center portion of the body has a midsection or member 424 and end sections 426 and 427. The body has an outer edge 428 and a first inner edge 429 surrounding a first opening 431. A second inner edge 432 surrounds a second opening 433. Body 429 has a plurality of inwardly directed and outwardly open notches 434 open to outer edge 428. The notches are equally spaced around the body. A first set of inside notches 436 are open to opening 431 and interrupt the inner edge 429. A second set of inside notches 437 are open to opening 433 and interrupt the second inside surface 432. The notches 434, 436 and 437 have bases that are along the same general line so that a second member can be interlocked with member 420. The midsection 424 of member 420 has a plurality of inwardly open notches 436A and 437A to provide the pairs of notches for the notches 436 and 437 on the notches on the outside segments C and F.

Figure 15:
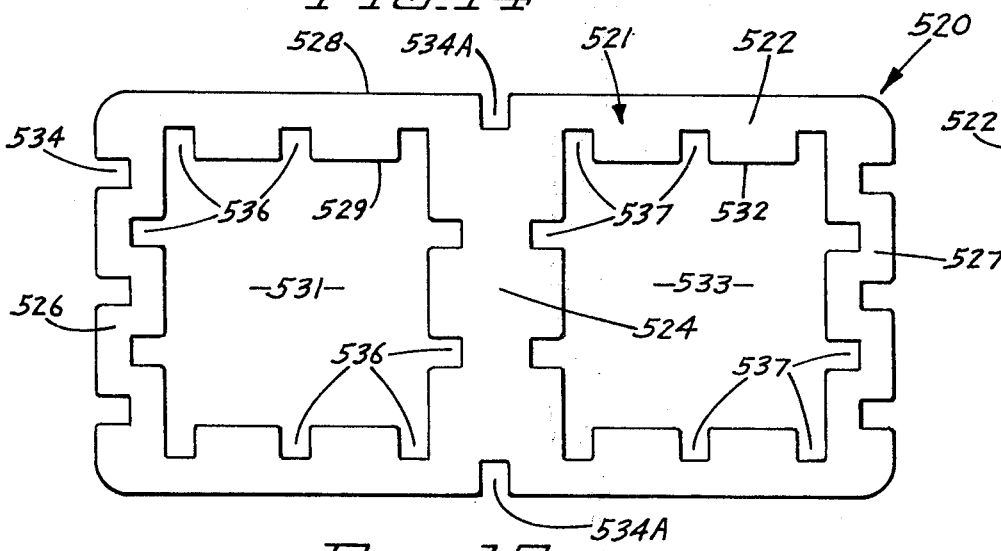
FIG. 15 is a front plan view of a sixth modification of the construction piece.
Figure 16:
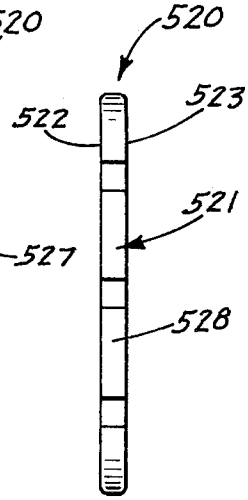
FIG. 16 is an end elevational view of FIG. 15.
Figure 17:
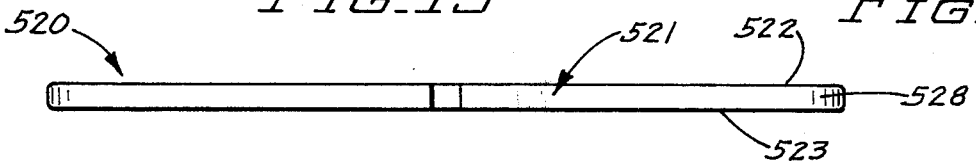
FIG. 17 is a bottom elevational view of FIG. 15.
Figure 19:
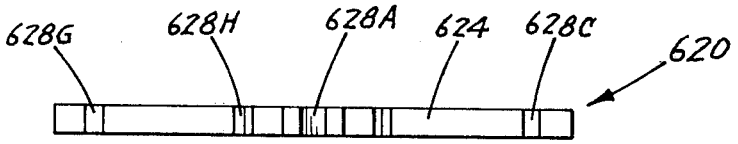
FIG. 19 is a top plan view of FIG. 18.
Figure 21:
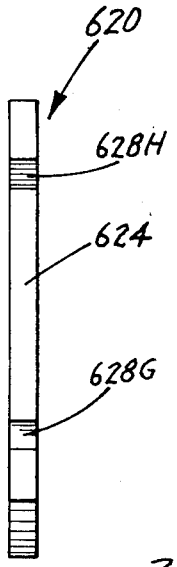
FIG. 21 is a left side elevational view of FIG. 18.

Referring to FIGS. 15–17, there is shown a sixth modification of the construction piece indicated generally at 520. Piece 520 has a flat flexible body 521 having generally flat continuous sides 522 and 523. The body 521 is a rectangular shape with round outside corners and has a center member 524 which provides the body with two openings 531 and 533. 521 has an outer edge 528, a first inner edge 529 and a second inner edge 532. Edge 529 surrounds opening 531. In a similar manner, edge 532 surrounds opening 533. The body end sections have outwardly open notches 534. Midsection 524 has outwardly open notches 534A. The remaining parts of outward edge 528 of the body 521 are continuous. The remainder of body 520 is identical to the body 420. Inside notches 536 in the left section of body 520 open to opening 531. Inside notches 537 in the right section of body 520 open to opening 533. Notches 536 and 537 are arranged in facing oposite pairs to accommodate separate parts of a second construction piece. The width of notches 534, 534A, 536 and 537 is the same as the thickness of the body 520.

Figure 18:
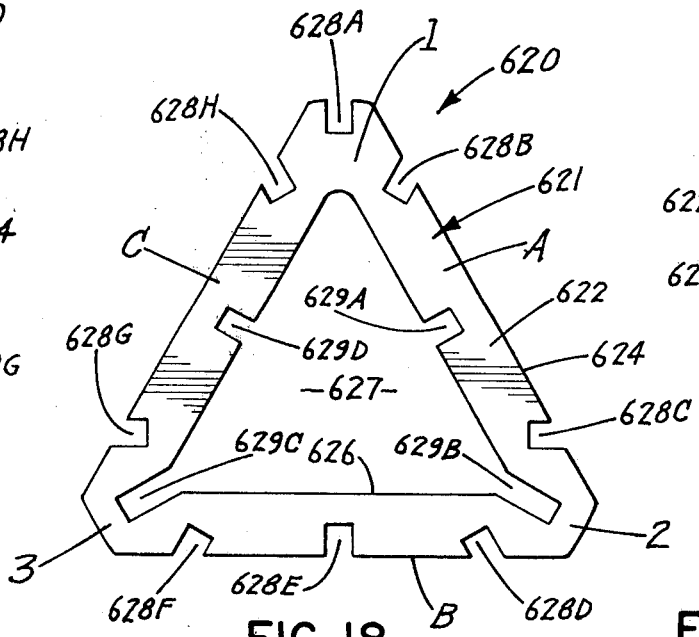
FIG. 18 is a front plan view of a seventh modification of the construction piece.
Figure 22:
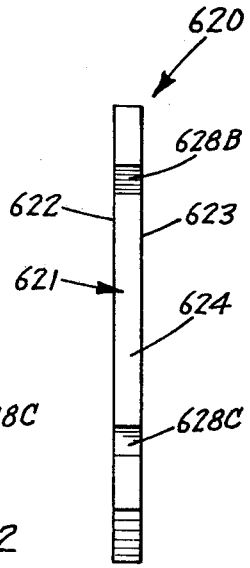
FIG. 22 is a right side elevational view of FIG. 18.
Figure 20:
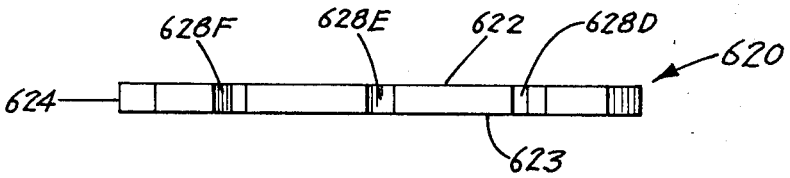
FIG. 20 is a bottom plan view of FIG. 18.

Referring to FIGS. 18–22, there is shown a seventh modification of the construction piece indicated generally at 620. Piece 620 has a generally triangular shape with a continuous generally flat flexible body 621. Body 621 flat opposite continuous sides 622 and 623 and an outer edge 624. As shown in FIG. 18, the body 621 is divided into segments A, B and C to form a generally equilateral triangle. Body 621 has a top apex section 1 and side apex sections 2 and 3. An outer notch 628A is located in apex section 1. A notch 628E is in vertical alignment with notch 628A in segment B to form a pair of coordinated notches 628A and 628E for receiving a second construction piece. Apex section 2 has an inwardly open notch 629B. Apex section 3 has a similar inwardly open notch 629C. Notch 629B is in alignment with an inside notch 629D to form a pair of notches to receive a second construction piece. Notch 629C is in alignment with a second notch 629A in segment A to form a pair of notches. Segments A, B and C have additional notches for accommodating a segment so that the segments can be interlocked with the piece 620. Notch 628B in segment A is in alignment with notch 628F in segment B. A second notch 628C in segment A is in alignment with notch 628G in segment C. Segment B has a notch 629D in alignment with notch 628 in segment C. The distance between all the pairs of notches are equal so that a second construction piece can be interlocked with the construction piece 620.

Each modification of the invention has a circuituous body having an outer edge and an inner edge. A plurality of pairs of notches located in the body permit the bodies to be interlocked to provide geometric structures. For example, the triangular, circular and square members can be square pieces 20, 120, 220, 320, and 620 can be interlocked to form a structural design. Construction pieces 420 and 520 can also be interlocked with the remaining construction pieces to form structural designs.

Adjacent pieces can be connected together with the use of a single notch as the body width from the face of a notch to the opposite edge is about equal to the width of a notch. Pairs of opposite notches are also used to interlock construction pieces together.

The construction pieces are made of flexible material so that they can be flexed into interlocking engagement with each other. For example, the circular member is flexed so that the notches 28 and 28A fit into the notches 229 and 229A of the piece 220 shown in FIG. 6.

The bodies 20, 120, 220, 320, 420, 520 and 620 are made of flexible and deformable material. The material has sufficient strength to normally maintain its shape, but can be flexed or changed in shape with hand force so that the pieces can be interlocked together. The material is preferably tear and bite resistant and nontoxic to the human body. The bodies may be made of varying colors, as red, white, blue, and like, so as to teach color recognition as well as color coordination. Examples of material that can be used to make the bodies are low density polyethylene, foamed polyurethane, rubber, fiber material, paper and the like. The bodies may be die cut from sheet material or formed in molds. Other methods of making the bodies can be employed to fabricate the constructive pieces.

This description sets forth several embodiments of the construction pieces of the invention. It is understood that other sizes and shapes and materials may be used. Also other notch arrangements can be employed to allow interlocking of the several construction pieces. The invention is defined in the following claims.

The embodiments of the invention in which an exclusive property or privilege is claimed are defined as follows:

1. A construction piece comprising: a circuitous ring-shaped flexible member having an outer edge, an inner edge, continuous side surfaces, and a plurality of notches in the outer edge and inner edge, each notch being formed by generally parallel side walls and a bottom in a part of the member, said notches including outwardly facing notches in the outer edge, said outwardly facing notches having at least one linearly aligned first pair of notches located in opposite portions of the member, said notches further including inwardly facing notches in the inner edge, said inwardly facing notches having at least one linearly aligned second pair of notches located in opposite portions of the member, each of said first and second pairs of notches having a bottom wall formed by a part of the member, the linear distance between the bottom walls of the first pair of notches being substantially the same as the linear distance between the bottom walls of the second pair of notches whereby two or more construction pieces can be connected together by mating the pieces together using the first pair of notches of one piece and the second pair of notches of another piece.

2. The piece of claim 1 wherein: the member is a generally flat member.

3. The piece of claim 1 wherein: the member has a substantially uniform thickness, said notches having a width generally the same dimension as the thickness of the member.

4. The piece of claim 1 wherein: the member has an annular shape.

5. The piece of claim 1 wherein: the member has a circular shape.

6. The piece of claim 1 wherein: the member has a plurality of angularly related segments.

7. The piece of claim 1 wherein: the member has a hexagonal shape.

8. The piece of claim 1 wherein: the member has a triangular shape.

9. The piece of claim 1 wherein: the member has a rectangular shape with long side sections and end sections.

10. The piece of claim 9 including: a cross member connected to the long side sections of the wall and spaced midway between the end sections.

11. The piece of claim 10 including: inwardly directed notches in the cross member.

12. The piece of claim 1 wherein: the member has a triangular shape with three segments joined with corner sections, each corner section having a notch.

13. The piece of claim 12 wherein: one corner section has an outwardly directed notch, and the other two corner sections have inwardly directed notches.

14. The piece of claim 12 wherein: one segment has a plurality of outwardly directed notches and the other two segments has inwardly and outwardly directed notches.

15. The piece of claim 12 wherein: the member is a continuous and generally flat member.

16. The piece of claim 1 wherein: the member has a triangular shape with first, second and third segments, a first corner section connecting the first and second segments, a second corner section connecting the second and third segments, a third corner section connecting the third and fourth segments, said first corner section having an outwardly directed notch, said second and third corner sections having inwardly directed notches, said third segment having an outwardly directed notch aligned with the notch in the first corner section, said first and second segments having inwardly directed notches aligned with the notches in the second and third corner segments respectively.

17. The piece of claim 16 including: a plurality of outwardly directed notches in the first, second and third segments, each notch in a segment being aligned with a notch in another segment.

18. The piece of claim 1 including: a plurality of first pairs of outwardly directed notches located in opposite portions of the member, each first pair of notches being linearly aligned.

19. The piece of claim 1 including: a plurality of second pairs of inwardly directed notches located in opposite portions of the member, each second pair of notches being linearly aligned.

20. The piece of claim 1 wherein: said outwardly facing notches are positioned in linearly aligned first pairs of notches, each first pair of notches having one notch in one portion of the member and a seocnd notch in a portion of the member opposite the one portion, said inwardly facing notches are positioned in linearly aligned pairs of notches, each second pair of notches having one notch in one portion of the member and a second notch in a portion of the member opposite the one portion, each notch of said first and second pairs of notches having a bottom wall, the linear distances between the bottom wall of each of the first and second pairs of notches being substantially the same whereby two pieces can be interlocked together.

21. The piece of claim 1 wherein: the member has four segments, at least two of said segments having inwardly and outwardly directed notches.

* * * * *

UNITED STATES PATENT AND TRADEMARK OFFICE

CERTIFICATE OF CORRECTION

PATENT NO. : 3,991,511

DATED : November 16, 1976

INVENTOR(S) : Jack G. McAllister et al

It is certified that error appears in the above-identified patent and that said Letters Patent are hereby corrected as shown below:

Column 3, line 34, "188" should be --133--.

Column 4, line 7, "24" should be --324--.

Column 4, line 18, "322" should be --332--.

Column 4, line 33, "429" should be --420--.

Signed and Sealed this

First Day of February 1977

[SEAL]

*Attest:*

RUTH C. MASON
*Attesting Officer*

C. MARSHALL DANN
*Commissioner of Patents and Trademarks*